United States Patent [19]

Koelling et al.

[11] Patent Number: 4,710,442

[45] Date of Patent: Dec. 1, 1987

[54] GRADIENT LAYER PANCHROMATIC PHOTORECEPTOR

[75] Inventors: Alan L. Koelling; William J. Murphy; Edward F. Mayer, all of San Jose, Calif.

[73] Assignee: Ricoh Systems, Inc., San Jose, Calif.

[21] Appl. No.: 828,371

[22] Filed: Feb. 11, 1986

[51] Int. Cl.[4] ..... G03G 5/082

[52] U.S. Cl. ..... 430/85; 430/95; 430/128

[58] Field of Search ..... 430/85, 76, 78, 95

[56] References Cited

U.S. PATENT DOCUMENTS 3,973,960 8/1976 Dulken et al. ..... 430/95

*Primary Examiner*—John L. Goodrow

*Attorney, Agent, or Firm*—Flehr, Hohbach, Test, Albritton, and Herbert

[57] ABSTRACT

An arsenic-selenium photoreceptor is provided wherein said photoreceptor is characterized by a gradient concentration of arsenic increasing from the bottom surface to the top surface of the photoreceptor such that the arsenic concentration is about 5 wt. % at a depth of about 5 to 10 microns from the top surface of the photoreceptor and is about 30 to 40 wt. % at the top surface of the photoreceptor.

6 Claims, 4 Drawing Figures

GRADIENT LAYER PANCHROMATIC PHOTORECEPTOR

The present invention is directed to an improved panchromatic photoreceptor having a gradient concentration of arsenic increasing from the bottom surface to the top surface of the photoreceptor.

In U.S. Pat. No. 2,822,300, there are described photoreceptors made from $As_2Se_3$ alloys. Although such photoreceptors have certain desirable properties, such as panchromaticity, resistance to crystallization, and surface hardness, compared to photoreceptors made from selenium or selenium-tellurium alloys, $AS_2SE_3$ photoreceptors are very expensive to produce. The expense of producing $As_2Se_3$ photoreceptors is due not only to the higher cost of arsenic versus selenium, but also to the more complicated equipment required to produce the selemium-arsenic alloy photoreceptor. Conventionally, photoreceptors are made by vapor deposition on a substrate (usually a drum) in a vacuum. For making selenium or selenium-tellurium photoreceptors, the substrate is normally maintained at a temperature in the range of 65° to 85° C., whereas when evaporating $As_2Se_3$, the substrate must be maintained in the temperature range of about 180° to 210° C.

U.S. Pat. No. 3,973,960 discloses electrographic recording material composed of a layer of selenium, selenium alloys or selenium compounds, with arsenic as an additive. The present invention is an improvement over U.S. Pat. No. 3,973,960, because less arsenic and lower substrate temperatures are utilized, making the photoreceptors less expensive and easier to manufacture. Furthermore, the photoreceptors of the present invention exhibit improved dark decay and fatigue characteristics.

The present invention is also an improvement over the selenium-arsenic alloy photoreceptors described in U.S. patent application, Ser. No. 535,646 filed Sept. 26, 1983. The photoreceptors described therein tend to develop internal stress in the photoconductive coating which causes surface cracks in the film when the photoreceptor is subjected to severe external stress, such as high to low temperature fluctuation or excessive use in a short period of time. For instance, when the photoreceptors are installed in a desktop copy machine and several thousand copies are made per day, the photoconductive coating has a tendency to develop surface cracks.

The present invention retains the advantages of the photoreceptor described in U.S. patent application, Ser. No. 535,646, such as panchromaticity, resistance to crystallization, less expensive manufacturing procedures, and surface hardness. In addition, the photoreceptors of the present invention are resistant to surface cracking and have improved cycling properties. They also contain less arsenic than conventional $As_2Se_3$ photoreceptors and are thus less expensive and easier to manufacture.

It is an object of the present invention to provide improved panchromatic selenium-arsenic alloy photoreceptors which are resistant to surface cracking.

This and other objects will become apparent from the following description and claims.

In general, the present invention is directed to a selenium-arsenic alloy photoreceptor comprising selenium-arsenic alloys and characterized by a gradient concentration of arsenic increasing from the bottom surface (which interfaces the substrate) to the top surface of the photoreceptor such that the arsenic concentration is about 5 wt. % at a depth of about 5 to 10 microns from the top surface of the photoreceptor and is about 30 to 40 wt. % at the top surface of the photoreceptor. Preferably, the arsenic concentration is about 5.0 wt. % at about 8 microns from the top surface of the photoreceptor and about 35 to 39 wt. % at the top surface of the photoreceptor. Preferably, the crucible load for the photoreceptor of the present invention comprises a selenium-arsenic alloy containing about 0 to 1.05 wt. % arsenic, a selenium-arsenic alloy containing about 10.0 to 25.0 wt. % arsenic, and a selenium-arsenic alloy containing about 35.0 to 40.0 wt. % arsenic.

Figure 1:
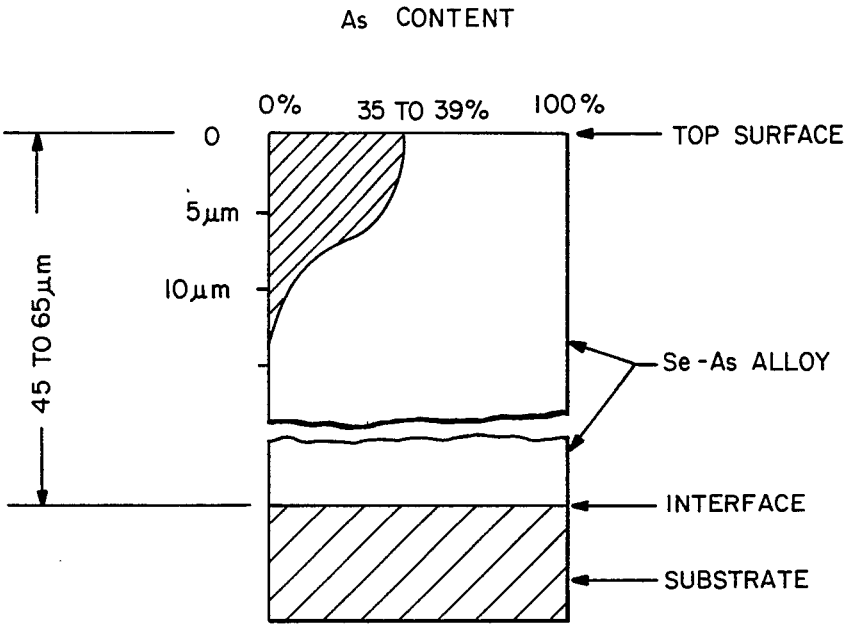
FIG. 1 is a schematic cross-section of a preferred embodiment of the photoreceptor of the present invention with a graph illustrating the gradient concentration of arsenic.

Referring to FIG. 1, there is shown a schematic cross-section of the photoreceptor of the present invention with a graph depicted thereon to illustrate the increasing gradient concentration of arsenic from the bottom surface to the top surface of a preferred embodiment of the selenium-arsenic alloy photoreceptor of the present invention. Specifically, the photoreceptor shown schematically in FIG. 1 has a total thickness of about 45–65 microns and an arsenic concentration of about 5 wt. % at about 10 microns below the top surface which increases to about 30 wt. % at about 5 microns below the top surface and is about 35 to 39 wt. % at the top surface.

The photoreceptor of the present invention is made by heating a mixture of selenium-arsenic alloys in a vacuum in a step-wise manner in accordance with predetermined time-temperature relationships such that the alloys are sequentially deposited on the substrate to form a photoconductive film with an increasing gradient concentration of arsenic from the substrate interface or bottom surface of the photoconductor to the top surface of the photoreceptor.

Figure 2:
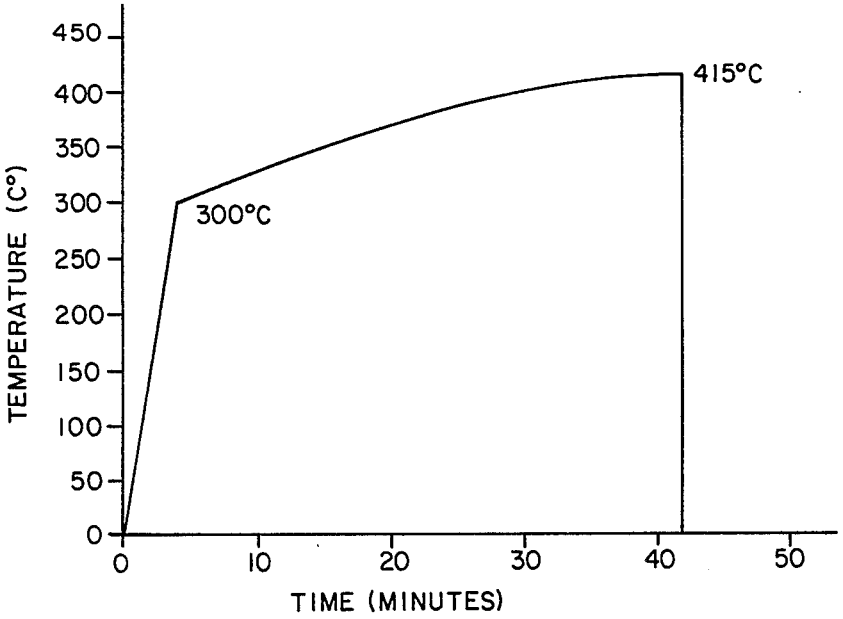
FIG. 2 shows a two-step crucible temperature heat up and a sine function crucible temperature profile for a method of making the photoreceptor of the present invention.

One preferred embodiment of the photoreceptor of the present invention is formed by setting the substrate temperature at about 75° C.±2° C. and then (a) raising the temperature of a mixture in a vacuum in less than 10 minutes to a first temperature in the range of from about 280° to 320° C., the mixture comprising a first selenium-arsenic alloy comprising up to about 1.05% arsenic by weight, a second selenium-arsenic alloy comprising from about 10 to 25% arsenic by weight, and a third selenium-arsenic alloy comprising from about 35 to 38.7% arsenic by weight, to commence evaporation of the mixture while condensing the mixture on a substrate surface; and (b) then raising the first temperature in less than 40 minutes to a second temperature in the range of from about 395° to 425° C. to substantially evaporate the mixture while condensing the mixture to form a photoreceptor of uniform thickness on the substrate, wherein the time-temperature curve for step (b) is a sine function, as illustrated in FIG. 2.

Figure 3:
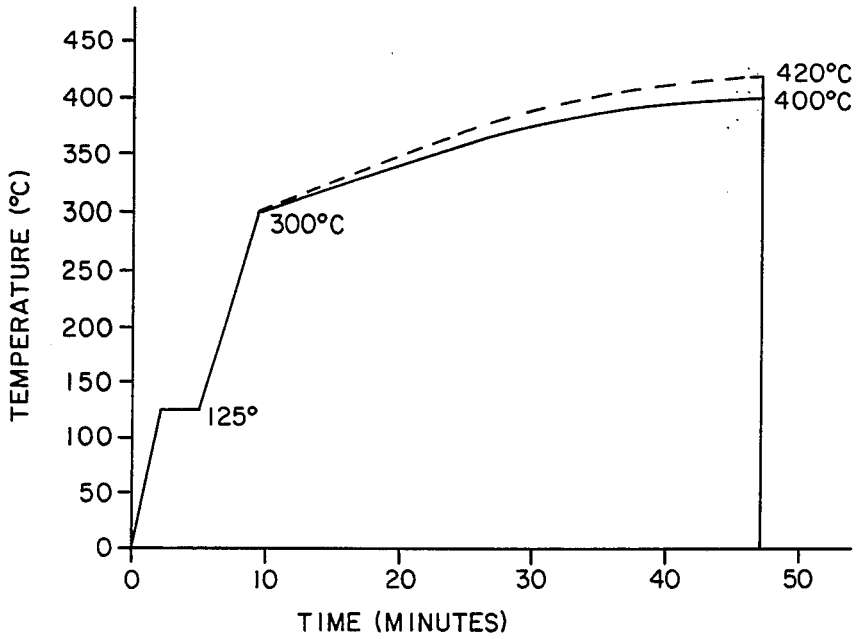
FIG. 3 shows a three-step crucible temperature heat up and a sine function crucible temperature profile for a method of making the photoreceptor of the present invention.

A second embodiment of the photoreceptor of the present invention is forned as described in the first embodiment except that during the first heating step, the mixture of the three selenium-arsenic alloys is maintained at an intermediate temperature in the range of from about 100° to 130° C. for a period of time sufficient to dry the mixture, as illustrated by the time-temperature profile in FIG. 3.

Figure 4:
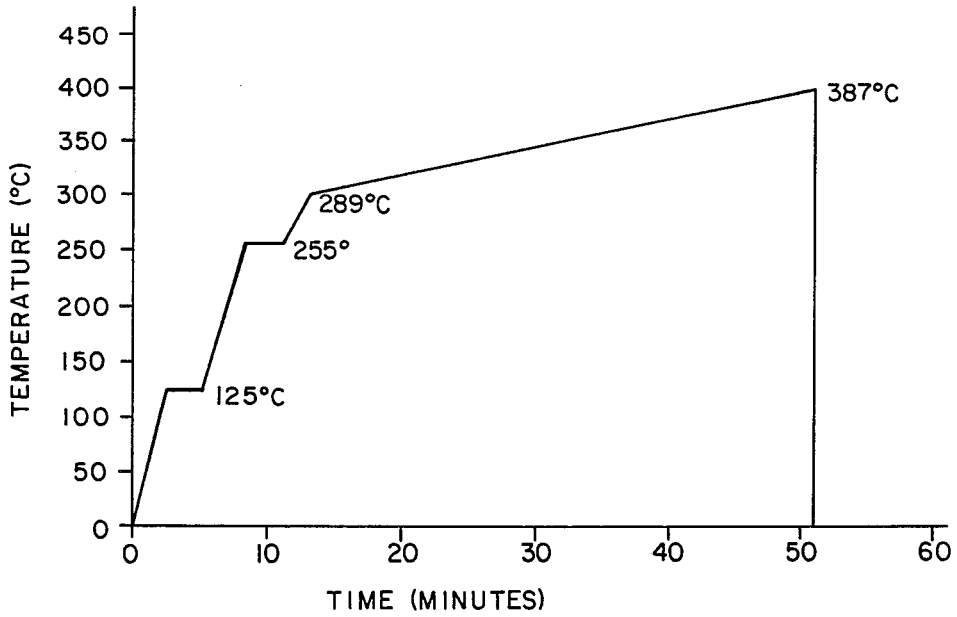
FIG. 4 shows a four-step crucible temperature heat up and a linear crucible temperature profile for a method of making the photoreceptor of the present invention.

A third embodiment of the photoreceptor of the present invention is formed by setting the substrate temperature at about 75° C.±2° C. and then (a) raising the temperature of a mixture in less than 3 minutes in a vacuum, said mixture comprising a first selenium-arsenic alloy comprising up to about 1.05% arsenic by weight, a second selenium-arsenic alloy comprising from about 10 to 25% arsenic by weight, and a third selenium-arsenic alloy comprising from about 35 to 38.7% arsenic by weight, to a first temperature in the range of from about 100 to 130° C. and maintaining this first temperature constant for a period of time sufficient to dry the mixture; then (b) raising the first temperature in less than 4 minutes to a second temperature in the range of from about 250 to 260° C. and maintaining this second temperature for a period of time sufficient to at least partially melt the mixture; then (c) raising the second temperature in less than 3 minutes to a third temperature in the range of from about 280° to 295° C. to commence evaporation of the mixture while condensing the mixture on a substrate surface; and (d) raising the third temperature in less than 45 minutes to a fourth temperature in the range of from about 380° to 410° C. to substantially evaporate the mixture while condensing the mixture to form a photoreceptor as a film of uniform thickness on the substrate, wherein the time-temperature curve for step (d) is linear, as illustrated in FIG. 4.

A fourth embodiment of the photoreceptor of the present invention is formed by setting the substrate temperature at about 75° C.±2° C. and then (a) raising the temperature of a mixture for less than 3 minutes in a vacuum, the mixture comprising a first selenium-arsenic alloy comprising up to about 1.05% arsenic by weight, a second selenium-arsenic alloy comprising from about 10 to 25% arsenic by weight, and a third selenium-arsenic alloy comprising from about 35 to 38.7% arsenic by weight, to a first temperature in the range of from about 100 to 130° C. and maintaining the first temperature constant for a period of time sufficient to dry the mixture; then (b) raising the first temperature in less than 4 minutes to a second temperature in the range of from about 250° to 260° C. and maintaining the second temperature for a period of time sufficient to at least partially melt the mixture; then (c) raising the second temperature in less than 3 minutes to a third temperature in the range of from about 280° to 295° C. and maintaining the third temperature for a period of time sufficient to commence evaporation of the mixture while condensing the mixture on a substrate surface; and (d) raising the third temperature in less than 3 minutes to a fourth temperature in the range of from about 380° to 390° C., and maintaining the fourth temperature for a period of time sufficient to substantially evaporate the mixture while condensing the mixture to form a photoreceptor as a film of uniform thickness on the substrate surface.

In accordance with a preferred method of making the photoreceptor of the present invention, the three selenium-arsenic alloys described above are placed in a single crucible located under the substrate to be coated in a high vacuum evaporator. One or more of the selenium-arsenic alloys may contain up to 1,500 ppm of a halogen, such as chlorine or iodine. Preferably, a major amount of the first selenium-arsenic alloy comprising up to about 1.05% arsenic by weight is placed in he crucible along with minor amounts of the second selenium-arsenic alloy comprising from about 10 to 25% arsenic by weight and the third selenium-arsenic alloy comprising from about 35 to 38.7% arsenic by weight. preferably, 75% or more of the first selenium-arsenic alloy comprising up to about 1.05% arsenic by weight is placed in the crucible.

The total amount of selenium-arsenic alloys to be used will depend upon the surface area of the substrate which is to be coated. Preferably, an amount of the alloys is used which is sufficient to coat the substrate surface uniformly such that the total thickness of the photoconductor film is from about 30 microns to about 120 microns. Preferably, the total thickness of the photoconductor film is in the range from about 45 microns to 65 microns.

Preferably, when halogen is added to the selenium-arsenic alloys, the first selenium-arsenic alloy comprising up to about 1.05% arsenic by weight contains from about 20 to 50 ppm chlorine, the second selenium-arsenic alloy comprising from about 10 to 25% arsenic by weight contains from about 150 to 400 ppm iodine, and the third selenium-arsenic alloy comprising from about 35 to 38.7% arsenic by weight contains from about 800 to 1200 ppm iodine.

During the evaporation process, the temperature of the crucible is carefully-controlled throughout the evaporation cycle in order to control the percentage of arsenic throughout the photoconductor film coated onto the substrate. The mandrel which holds the substrates in place is maintained at a temperature in the range of from about 70° to 80° C., preferably 75° C.±1° C., during the entire evaporation procedure, which is approximately the same temperature used when vaporizing selenium or selenium-tellurium alloys onto substrates.

The photoreceptors according to the present invention, in addition to having improved panchromaticity, resistance to crystallization, and surface hardness, are resistant to surface cracking. The photoreceptors according to the present invention exhibit lower dark decay and fatigue than conventional $As_2Se_3$ photoreceptors. In addition, the photoreceptors of the present invention may be charged the same surface potential as conventional $As_2Se_3$ photoreceptors with the added advantage that the photoreceptor of the present invention uses about 25% less charging current. Further, the photoreceptor of the present invention has a broader spectral response than a photoreceptor containing only one or two of the selenium-arsenic alloys described herein.

EXAMPLE 1

A photoreceptor was made by placing three selenium-arsenic alloys in a single evaporation crucible located under the substrates to be coated. The substrates are two aluminun drums. The crucible was charged with (1) 152 grams (83 wt. %) of a first selenium-arsenic alloy containing 0.4% arsenic by weight and 24 ppm chlorine, (2) 16 grams (8.5 wt. %) of a selenium-arsenic alloy containing 15.2% arsenic by weight and 310 ppm iodine, and (3) 16 grams (8.5 wt. %) of a third selenium-arsenic alloy containing 35.5% arsenic by weight and 1,000 ppm iodine.

The rotating mandrel holding the drum was maintained at a temperature of 75° C.±2° C. The crucible was heated under vacuum in an enclosed system evacuated to about $5\times10^{-5}$ torr. The temperature of the crucible was carefully controlled throughout the evaporation cycle in order to control the percentage of arsenic throughout the film.

The crucible was heated according to the time-temperarture profile shown in FIG. 2. The crucible was heated in vacuum to raise the temperature of the mixture in less than 10 minutes, preferably 4 minutes to a first temperature of about 280° to 320° C., preferably 300° C., to commence evaporation of the mixture while simultaneously condensing the mixture on the substrate surface. Then, the first temperature was raised in less than 40 minutes, preferably 38 minutes, to a second temperature in the range of about 395° to 425° C., preferably 415° C., to substantially evaporate the mixture while simultaneously condensing the mixture to form a photoreceptor of uniform thickness on the substrate. The desirable temperature increase of the second step follows a sinusoidal temperature-time curve (T=a sine (bt)), as shown in FIG. 2, wherein T is temperature in °C., t is time in minutes, and a and b are constants.

Alternative functions to the sine function may also be used such as $T=a\sqrt{t}$ or $T=at$, wherein T and t are defined above.

This evaporation procedure produced two high quality drums having a photoconductor film thickness of 55±1 microns with an increasing gradient concentration of arsenic from the substrate interface to the top surface such that the arsenic concentration was about 5 wt. % at about 8 microns below the top surface and about 35.5 wt. % at the top surface. The drums were used in a desktop copy machine and produced copies having excellent quality.

EXAMPLE 2

A photoreceptor was made as in Example 1, except that the three selenium-arsenic alloys were as follows: (1) 152 grams (83 wt. %) of a selenium-arsenic alloy containing 1.02% arsenic by weight and 42 ppm chlorine,; (2) 16 grams (8.5 wt. %) of a selenium-arsenic alloy containing 15.0% arsenic by weight and 200 ppm iodine; and (3) 16 grams (8.5 wt. %) of a selenium-arsenic alloy containing 35.5% arsenic by weight and 1,000 ppm iodine.

EXAMPLE 3

A photoreceptor was made as in Example 1, except that the three selenium-arsenic alloys were as follows: (1) 136 grams (74 wt. %) of a selenium-arsenic alloy containing 0.4% arsenic by weight and 42 ppm chlorine; (2) 32 grams (17.4 wt. %) of a selenium-arsenic alloy containing 15.0% arsenic by weight and 200 ppm iodine; and (3) 16 grams (8.6 wt. %) of a selenium-arsenic alloy containing 35.5% arsenic by weight and 1,000 ppm iodine.

EXAMPLE 4

A photoreceptor was made as in Example 1, except that the three selenium-arsenic alloys were as follows: ek (1) 152 grams (74 wt. %) of a selenium-arsenic alloy containing 0.4% arsenic by weight and 42 ppm chlorine,; (2) 16 grams (8.6 wt. %) of a selenium-arsenic alloy containing 15.0% arsenic by weight and 200 ppm iodine; and 3) 32 grams (17.4 wt. %) of a selenium-arsenic alloy containing 35.5% arsenic by weight and 1,000 ppm iodine.

All photoreceptors made in Examples 1 through 4 had broad spectral response, good resistance to crystallization, good cycling properties, and were resistant to surface cracking. In addition, they were relatively inexpensive to manufacture when compared to a photoreceptor made of $As_2Se_3$.

EXAMPLE 5

A photoreceptor is made according to the crucible temperature profile shown in FIG. 3. A mixture of three selenium-arsenic alloys comprising a first selenium-arsenic alloy comprising up to about 1.05% arsenic by weight, a second selenium-arsenic alloy comprising from about 10 to 25% arsenic by weight, and a third selenium-arsenic alloy comprising from about 35.0 to 38.7% arsenic by weight, is heated in a crucible in vacuum to raise the temperature of the mixture in a period of less than 10 minutes, preferably 9 minutes, to a temperature in the range of 280° to 320° C., preferably 300° C., to commence evaporation of the mixture while simultaneously condensing the mixture on a substrate surface maintained at a temperature of about 75° C.±2° C. As shown in FIG. 3, the mixture is maintained for a period of time sufficient to dry the mixture at a temperature in the range of 100° to 130° C., preferably 125° C. As shown this intermediate drying step temperature is attained in about 2 minutes and maintained for a period of approximately three minutes. Then, as shown in FIG. 3, the temperature is raised to its second temperature over a ramp of less than 40 minutes, preferably 38 minutes, to another temperature in the range of 395° to 425° C. preferably 415° C. to substantially evaporate the mixture while simultaneously condensing the mixture to form a photoreceptor of uniform thickness on the substrate. The time-temperature profile of the ramp between the 300° C. and 400° C. points shown in FIG. 3 is a sine function of the form $T=a$ sine($bt$), wherein T, t, a, and b are defined above. The dotted ramp between 300° C. and 420° C. points on FIG. 3 is another sine function of the same form as above having different a and b constants. An alternative function to the sine function is the relationship $T=a\sqrt{t}$ wherein T, a, t are defined above.

EXAMPLE 6

A photoreceptor is made according to the time-temperature curve shown in FIG. 4 by heating a mixture of the three selenium-arsenic alloys described in Example 5. The three alloys are placed in a crucible which is placed under the substrate and enclosed in a system evacuated to approximately $5\times10^{-5}$ torr. The substrate is maintained at a temperature of about 75° C.±2° C.

The crucible is heated using less than a three minute ramp, preferably a two minute ramp, to a temerature in the range of 100° to 130° C., preferably 125° C., and is held at this point for a period of time sufficient to drive the moisture from the mixture preferably about three minutes. Then the crucible is heated to a second temperature in the range of 250° to 260° C., preferably 255° C., using less than a four minute ramp, preferably a three minute ramp, in order to partially melt the mixture so that when the evaporation temperature is reached, there is less spatter, thereby achieving a coating with minimal surface defects. The temperature is then increased using a ramp of less than three minutes, preferably 2 minutes, to a third temperature in the range of 280° to 295° C., preferably 289° C., to commence evaporation of the mixture while simultaneously condensing the mixture on the substrate surface positioned above the crucible. Finally, the crucible temperature is raised to a fourth temperature in less than 45 minutes, preferably in about 38 minutes, to substantially evaporate the mixture while simultaneously condensing the mixture to form a film of uniform thickness on the substrate. The final temperature obtained is in the range of 380° to 410° C., preferably 387° C. The ramp from 289° C. to 387° C. is attained in a linear manner as shown in FIG. 4.

Alternative methods to that shown in FIG. 4 may be utilized, such as utilizing a steeper final ramp starting at 289° C. and reaching a temperature between 400° to 405° C. in less than 45 minutes.

What is claimed is:

1. A photoreceptor comprising selenium-arsenic alloys, characterized by a gradient concentration of arsenic increasing from the bottom surface which interfaces a substrate to the top surface of the photoreceptor such that the arsenic concentration is about 5 wt. % at a depth of about 5 to 10 microns from the top surface of the photoreceptor and is about 35 to 40 wt. % at the top surface of the photoreceptor, wherein said photoreceptor is prepared by vapor deposition of a mixture of selenium-arsenic alloys, comprising about 74.0 wt. % or more of a selenium-arsenic alloy containing about 0 to 1.05 wt. % arsenic, and about 26.0 wt. % or less of a selenium-arsenic alloy containing about 10.0 to 25.0 wt. % arsenic and a selenium-arsenic alloy containing about 35.0 to 40.0 wt. % arsenic, onto a substrate wherein the mandrel holding the substrate is maintained at a temperature in the range of about 70°–80° C. during the entire evaporation procedure.

2. A photoreceptor according to claim 1, wherein the photoreceptor is about 30 to 120 microns thick.

3. A photoreceptor according to claim 1, wherein the photoreceptor is about 45 to 65 microns thick.

4. A photoreceptor according to claim 1, wherein the arsenic concentration is about 5 wt. % at about 8 microns from the top surface of the photoreceptor and about 35 to 39 wt. % at the top surface of the photoreceptor.

5. A photoreceptor according to claim 1, wherein said selenium-arsenic alloys contain about 0 to 1,500 ppm halogen.

6. A photoreceptor according to claim 5 wherein said halogen is selected from chlorine and iodine.

* * * * *

UNITED STATES PATENT AND TRADEMARK OFFICE

CERTIFICATE OF CORRECTION

PATENT NO. 4,710,442

DATED December 1, 1987

INVENTOR(S) : Koelling, et al.

It is certified that error appears in the above—identified patent and that said Letters Patent is hereby corrected as shown below:

On the face of the patent, the assignees should read as follows:

--Assignees: Ricoh Systems, Inc., San Jose, California, and Ricoh Company, Ltd., Tokyo, Japan.--

Signed and Sealed this

Thirtieth Day of May, 1989

*Attest:*

*Attesting Officer*

DONALD J. QUIGG

*Commissioner of Patents and Trademarks*